US006880626B2

(12) United States Patent
Lindemuth et al.

(10) Patent No.: US 6,880,626 B2
(45) Date of Patent: Apr. 19, 2005

(54) VAPOR CHAMBER WITH SINTERED GROOVED WICK

(75) Inventors: James E. Lindemuth, Lititz, PA (US); John H. Rosenfeld, Lancaster, PA (US)

(73) Assignee: Thermal Corp., Stanton, DE (US)

( * ) Notice: Subject to any disclaimer, the term of this patent is extended or adjusted under 35 U.S.C. 154(b) by 0 days.

(21) Appl. No.: 10/606,905

(22) Filed: Jun. 26, 2003

(65) Prior Publication Data

US 2004/0069455 A1 Apr. 15, 2004

Related U.S. Application Data

(60) Provisional application No. 60/407,059, filed on Aug. 28, 2002.

(51) Int. Cl.[7] ..... F28D 15/00

(52) U.S. Cl. ..... 165/104.26; 165/104.33; 361/700; 174/15.2; 257/715

(58) Field of Search ..... 165/104.26, 104.21, 165/104.33, 185; 361/700; 257/714, 715; 174/15.2

(56) References Cited

U.S. PATENT DOCUMENTS 3,537,514 A 11/1970 Levedahl
3,598,180 A * 8/1971 Moore, Jr. ..... 165/133
3,613,778 A 10/1971 Feldman, Jr.
3,675,711 A 7/1972 Bilinski et al.
3,680,189 A * 8/1972 Noren ..... 29/890.032
3,681,843 A 8/1972 Arcella et al.
3,788,388 A 1/1974 Barkmann
4,042,316 A 8/1977 Rabe
4,046,190 A * 9/1977 Marcus et al. ..... 165/104.26
4,118,756 A 10/1978 Nelson et al.
4,177,646 A 12/1979 Guadagnin et al.
4,231,423 A 11/1980 Haslett
4,274,479 A * 6/1981 Eastman ..... 165/104.26

(Continued)

*Primary Examiner*—Terrell McKinnon
(74) *Attorney, Agent, or Firm*—Duane Morris LLP

(57) ABSTRACT

A heat pipe heat spreader is provided having a substantially L-shaped enclosure with an internal surface and a plurality of post projecting from the surface. A working fluid is disposed within the enclosure, and a grooved wick is formed on at least a portion of the internal surface. The grooved wick includes a plurality of individual particles having an average diameter, and including at least two lands that are in fluid communication with one another through a particle layer disposed between the at least two lands that comprises less than about six average particle diameters. A method for making a grooved heat pipe wick on an inside surface of a heat pipe container a layer of sintered powder between adjacent grooves that comprises no more than about six average particle diameters.

4 Claims, 9 Drawing Sheets

U.S. PATENT DOCUMENTS 4,279,479 A 7/1981 Schrier
4,327,752 A 5/1982 Hickel
4,354,482 A 10/1982 Beisecker
4,361,133 A 11/1982 Bonnema
4,365,851 A 12/1982 Andres et al.
4,366,526 A 12/1982 Lijoi et al.
4,374,528 A 2/1983 Tittert
4,382,448 A 5/1983 Tittert
4,489,777 A 12/1984 Del Bagno et al.
4,503,483 A 3/1985 Basiulis
4,557,413 A 12/1985 Lewis et al.
4,616,699 A 10/1986 Grote
4,641,404 A 2/1987 Seydel et al.
4,697,205 A 9/1987 Eastman
4,748,314 A 5/1988 Desage
4,765,396 A 8/1988 Seidenberg
4,777,561 A 10/1988 Murphy et al.
4,807,697 A 2/1989 Gernert et al.
4,819,719 A 4/1989 Grote et al.
4,830,097 A 5/1989 Tanzer
4,840,224 A 6/1989 Dietzsch
4,865,729 A 9/1989 Saxena et al.
4,880,052 A 11/1989 Meyer, IV et al.
4,883,116 A 11/1989 Seidenberg et al.
4,885,129 A 12/1989 Leonard et al.
4,912,548 A 3/1990 Shanker et al.
4,921,041 A 5/1990 Akachi
4,929,414 A 5/1990 Leonard et al.
4,931,905 A 6/1990 Cirrito et al.
4,960,202 A 10/1990 Rice et al.
4,982,274 A 1/1991 Murase et al.
5,059,496 A 10/1991 Sindorf
5,076,352 A 12/1991 Rosenfeld et al.
5,101,560 A 4/1992 Leonard et al.
5,103,897 A 4/1992 Cullimore et al.
5,148,440 A 9/1992 Duncan
5,160,252 A 11/1992 Edwards
5,200,248 A 4/1993 Thompson et al.
5,219,020 A 6/1993 Akachi
5,242,644 A 9/1993 Thompson et al.
5,253,702 A 10/1993 Davidson et al.
5,268,812 A 12/1993 Conte
5,283,715 A 2/1994 Carlsten et al.
5,320,866 A 6/1994 Leonard
5,331,510 A 7/1994 Ouchi et al.
5,333,470 A 8/1994 Dinh
5,349,237 A 9/1994 Sayka et al.
5,408,128 A 4/1995 Furnival
5,409,055 A 4/1995 Tanaka et al.
5,465,782 A * 11/1995 Sun et al. ..... 165/104.26
5,522,455 A 6/1996 Brown et al.
5,549,394 A 8/1996 Nowak et al.
5,642,776 A * 7/1997 Meyer et al. ..... 165/104.26
5,664,890 A 9/1997 Nowak et al.
5,711,816 A 1/1998 Kirlin et al.
5,769,154 A 6/1998 Adkins et al.
5,826,645 A 10/1998 Meyer, IV et al.
5,847,925 A 12/1998 Progl et al.
5,880,524 A 3/1999 Xie
5,883,426 A 3/1999 Tokuno et al.
5,947,193 A 9/1999 Adkins et al.
5,950,710 A 9/1999 Liu
6,041,211 A 3/2000 Hobson et al.
6,055,157 A 4/2000 Bartilson
6,056,044 A 5/2000 Benson et al.
6,082,443 A * 7/2000 Yamamoto et al. .... 165/104.26
6,148,906 A 11/2000 Li et al.
6,154,364 A 11/2000 Girrens et al.
6,158,502 A 12/2000 Thomas
6,167,948 B1 1/2001 Thomas
6,169,852 B1 1/2001 Liao et al.
6,227,287 B1 * 5/2001 Tanaka et al. ..... 165/80.4
6,230,407 B1 5/2001 Akutsu
6,239,350 B1 5/2001 Sievers et al.
6,256,201 B1 7/2001 Ikeda et al.
6,269,866 B1 * 8/2001 Yamamoto et al. .... 165/104.26
6,293,333 B1 * 9/2001 Ponnappan et al. .... 165/104.26
6,302,192 B1 10/2001 Dussinger et al.
6,303,081 B1 10/2001 Mink et al.
6,382,309 B1 5/2002 Kroliczek et al.
6,388,882 B1 5/2002 Hoover et al.
6,397,935 B1 * 6/2002 Yamamoto et al. .... 165/104.26
6,418,017 B1 7/2002 Patel et al.
6,536,510 B1 * 3/2003 Khrustalev et al. .... 165/104.33
2001/0004934 A1 * 6/2001 Yamamoto et al. .... 165/104.11
2002/0170705 A1 * 11/2002 Cho et al. ..... 165/104.26
2003/0136550 A1 * 7/2003 Tung et al. ..... 165/104.26

* cited by examiner

VAPOR CHAMBER WITH SINTERED GROOVED WICK

CROSS REFERENCE TO RELATED APPLICATIONS

This application claims priority from co-pending Provisional Patent Application Ser. No. 60/407,059, filed Aug. 28, 2002, and entitled VAPOR CHAMBER THERMAL SOLUTION FOR MOBILE PROCESSOR COOLING.

FIELD OF THE INVENTION

The present invention generally relates to the management of thermal energy generated by electronic systems, and more particularly to a heat pipe-related device and method for efficiently and cost effectively routing and controlling the thermal energy generated by various components of an electronic system.

BACKGROUND OF THE INVENTION

Semiconductors are continuously diminishing in size. Corresponding to this size reduction is an increase in the power densities of semiconductors. This, in turn, creates heat proliferation problems which must be resolved because excessive heat will degrade semiconductor performance. Heat pipes are known in the art for both transferring and spreading heat that is generated by electronic devices.

Heat pipes use successive evaporation and condensation of a working fluid to transport thermal energy from a heat source to a heat sink. Heat pipes can transport very large amounts of thermal energy in a vaporized working fluid, because most working fluids have a high heat of vaporization. Further, the thermal energy can be transported over relatively small temperature differences between the heat source and the heat sink. Heat pipes generally use capillary forces created by a porous wick to return condensed working fluid, from a heat pipe condenser section (where transported thermal energy is given up at the heat sink) to an evaporator section (where the thermal energy to be transported is absorbed from the heat source).

Heat pipe wicks are typically made by wrapping metal screening of felt metal around a cylindrically shaped mandrel, inserting the mandrel and wrapped wick inside a heat pipe container and then removing the mandrel. Wicks have also been formed by depositing a metal powder onto the interior surfaces of the heat pipe and then sintering the powder to create a very large number of intersticial capillaries. Typical heat pipe wicks are particularly susceptible to developing hot spots where the liquid condensate being wicked back to the evaporator section boils away and impedes or blocks liquid movement. Heat spreader heat pipes can help improve heat rejection from integrated circuits. A heat spreader is a thin substrate that absorbs the thermal energy generated by, e.g., a semiconductor device, and spreads the energy over a large surface of a heat sink.

Ideally, a wick structure should be thin enough that the conduction delta-T is sufficiently small to prevent boiling from initiating. Thin wicks, however, have not been thought to have sufficient cross-sectional area to transport the large amounts of liquid required to dissipate any significant amount of power. For example, the patent of G. Y. Eastman, U.S. Pat. No. 4,274,479, concerns a heat pipe capillary wick structure that is fabricated from sintered metal, and formed with longitudinal grooves on its interior surface. The Eastman wick grooves provide longitudinal capillary pumping while the sintered wick provides a high capillary pressure to fill the grooves and assure effective circumferential distribution of the heat transfer liquid. Eastman describes grooved structures generally as having "lands" and "grooves or channels". The lands are the material between the grooves or channels. The sides of the lands define the width of the grooves. Thus, the land height is also the groove depth. Eastman also states that the prior art consists of grooved structures in which the lands are solid material, integral with the casing wall, and the grooves are made by various machining, chemical milling or extrusion processes. Significantly, Eastman suggests that in order to optimize heat pipe performance, his lands and grooves must be sufficient in size to maintain a continuous layer of fluid within a relatively thick band of sintered powder connecting the lands and grooves such that a reservoir of working fluid exists at the bottom of each groove. Thus, Eastman requires his grooves to be blocked at their respective ends to assure that the capillary pumping pressure within the groove is determined by its narrowest width at the vapor liquid interface. In other words, Eastman suggests that these wicks do not have sufficient cross-sectional area to transport the relatively large amounts of working fluid that is required to dissipate a significant amount of thermal energy.

SUMMARY OF THE INVENTION

The present invention provides a heat pipe heat spreader having a substantially L-shaped enclosure with an internal surface and a plurality of posts projecting from the surface. A working fluid is disposed within the enclosure, and a grooved wick is formed on at least a portion of the internal surface. The grooved wick includes a plurality of individual particles having an average diameter, and including at least two lands that are in fluid communication with one another through a particle layer disposed between at least two lands that comprises less than about six average particle diameters.

A method for making a heat pipe wick on an inside surface of a heat pipe container is also provided comprising the steps of positioning a mandrel having a grooved contour and a plurality of recesses within a portion of the container. Providing a slurry of metal particles having an average particle diameter and that are suspended in a viscous binder. Coating at least part of the inside surface of the container with the slurry so that the slurry conforms to the grooved contour of the mandrel and forms a layer of slurry between adjacent grooves that comprises no more than about six average particle diameters. Drying the slurry to form a green wick, and then heat treating the green wick to yield a final composition of the heat pipe wick.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
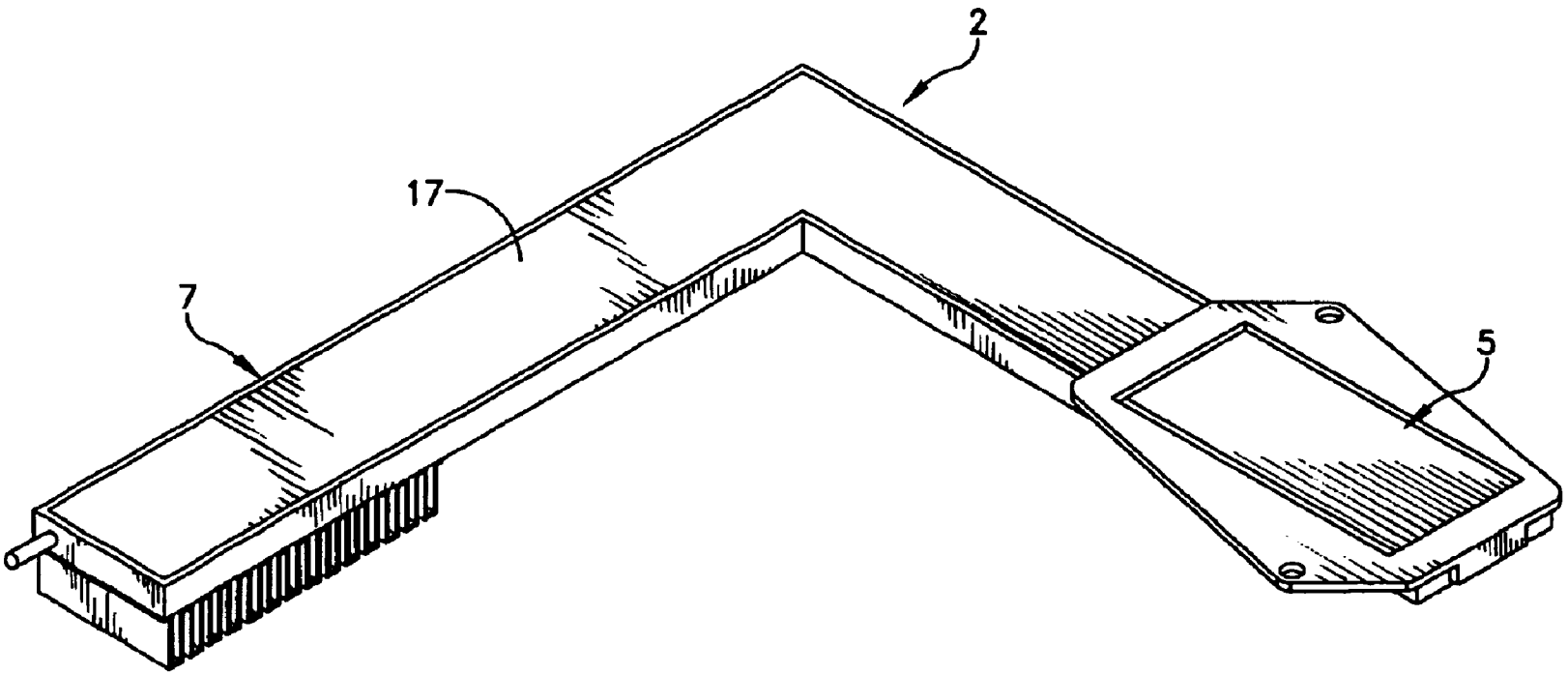
FIG. 1 is a perspective view of a heat pipe heat spreader formed in accordance with the present invention.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses are intended to cover the structures described, suggested, or rendered obvious by the written description or drawings for performing the recited function, including not only structural equivalents but also equivalent structures.

Figure 2:
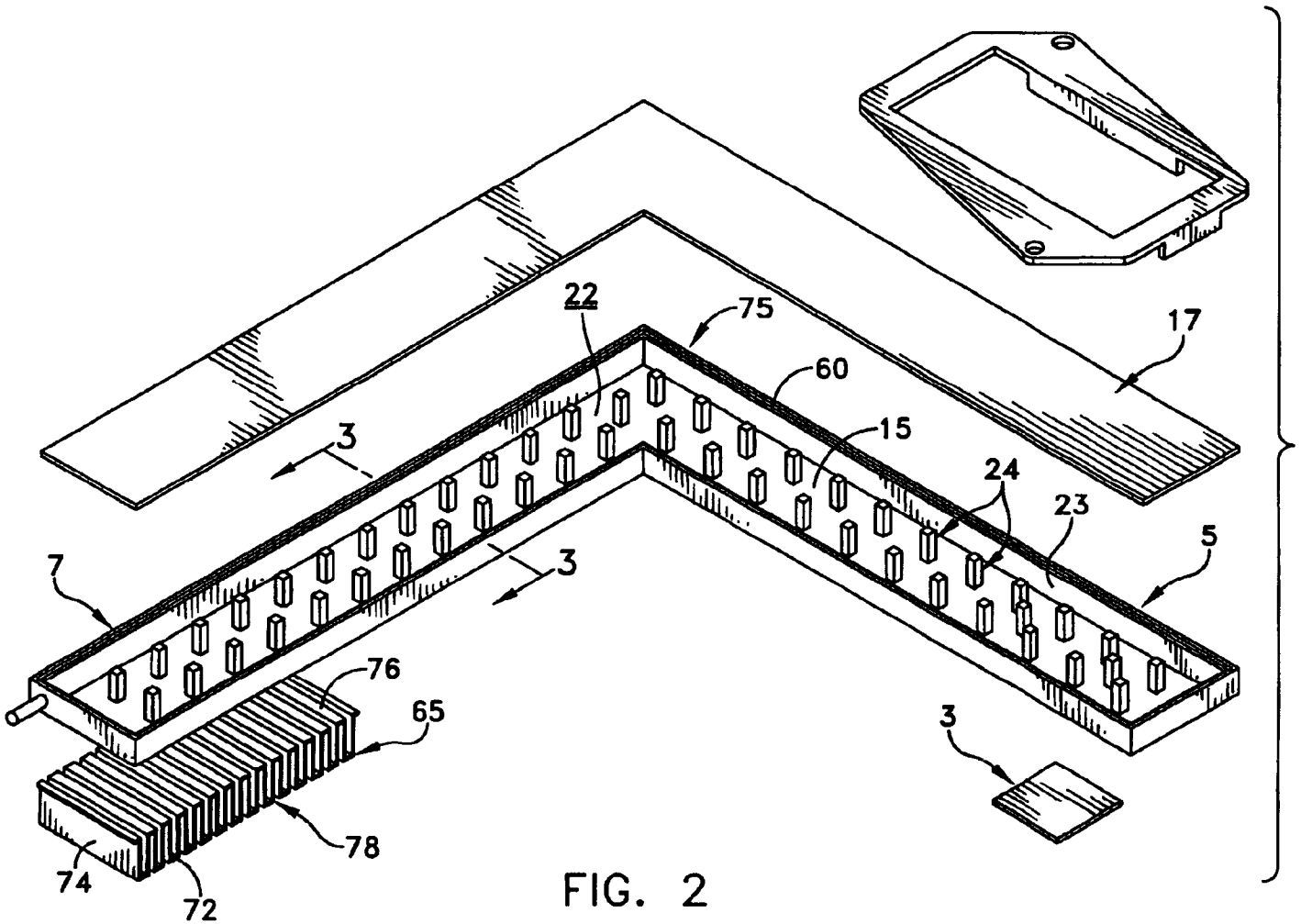
FIG. 2 is an exploded perspective view of the heat pipe heat spreader shown in FIG. 1.

Referring to FIGS. 1 and 2, the present invention comprises a substantially planar heat pipe heat spreader 2 that is sized and shaped to transfer and spread the thermal energy generated by at least one semiconductor device 3. Heat pipe heat spreader 2 comprises an evaporator section 5, a condenser section 7, and a sintered wick 9 (FIGS. 3 and 11–14). Although heat pipe heat spreader 2 may be formed as a straight, rectangular structure, it is often convenient for heat pipe heat spreader 2 to comprise a substantial "L"-shape, i.e., having two legs that are integrally joined at one end so as to form an approximately 90° angle between them. Of course, by "L-shaped" it will be understood that other bent or simple curved structures may also be used with similar effect.

Figure 3:
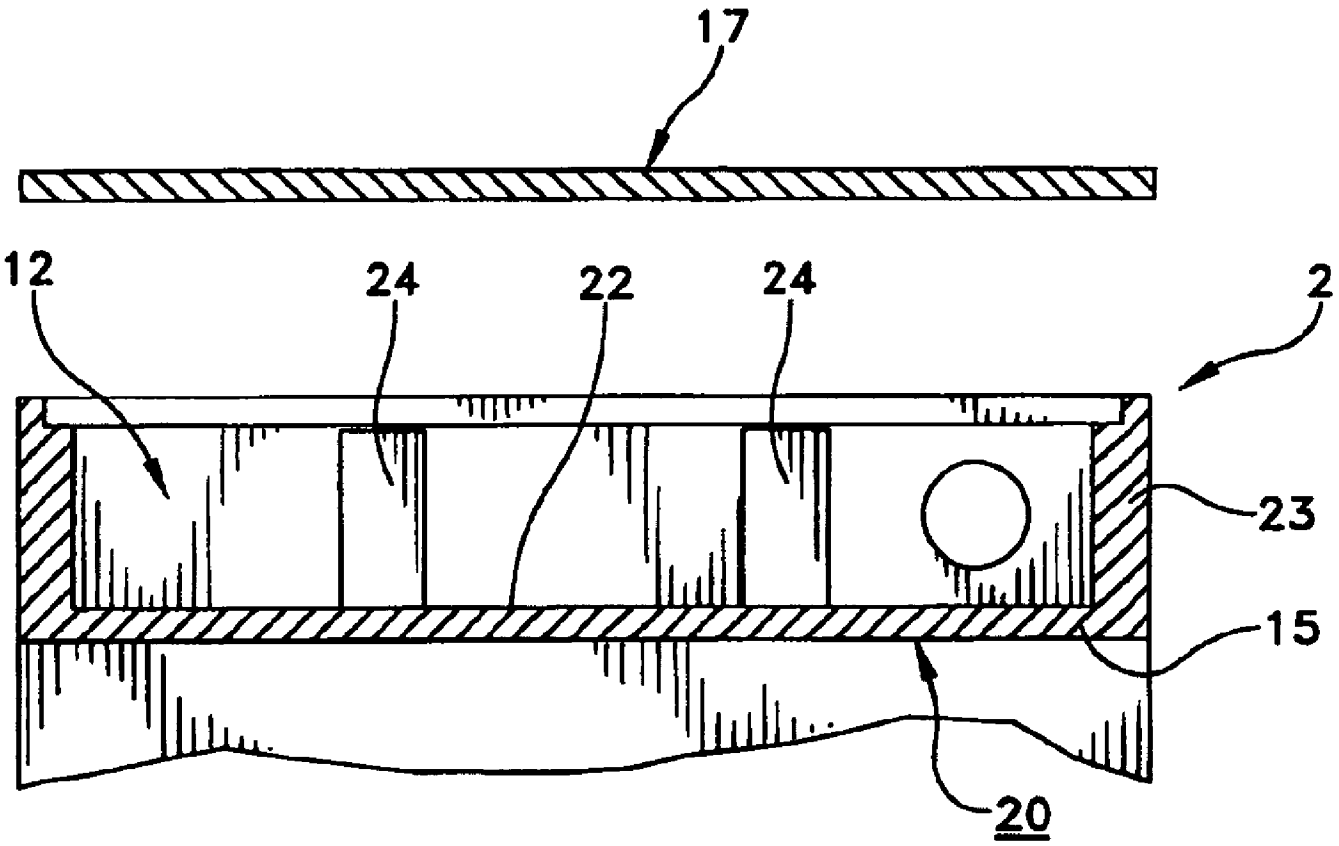
FIG. 3 is a cross-sectional view of the heat pipe heat spreader shown in FIG. 2 as taken along lines 3—3 in FIG. 2.
Figure 4:
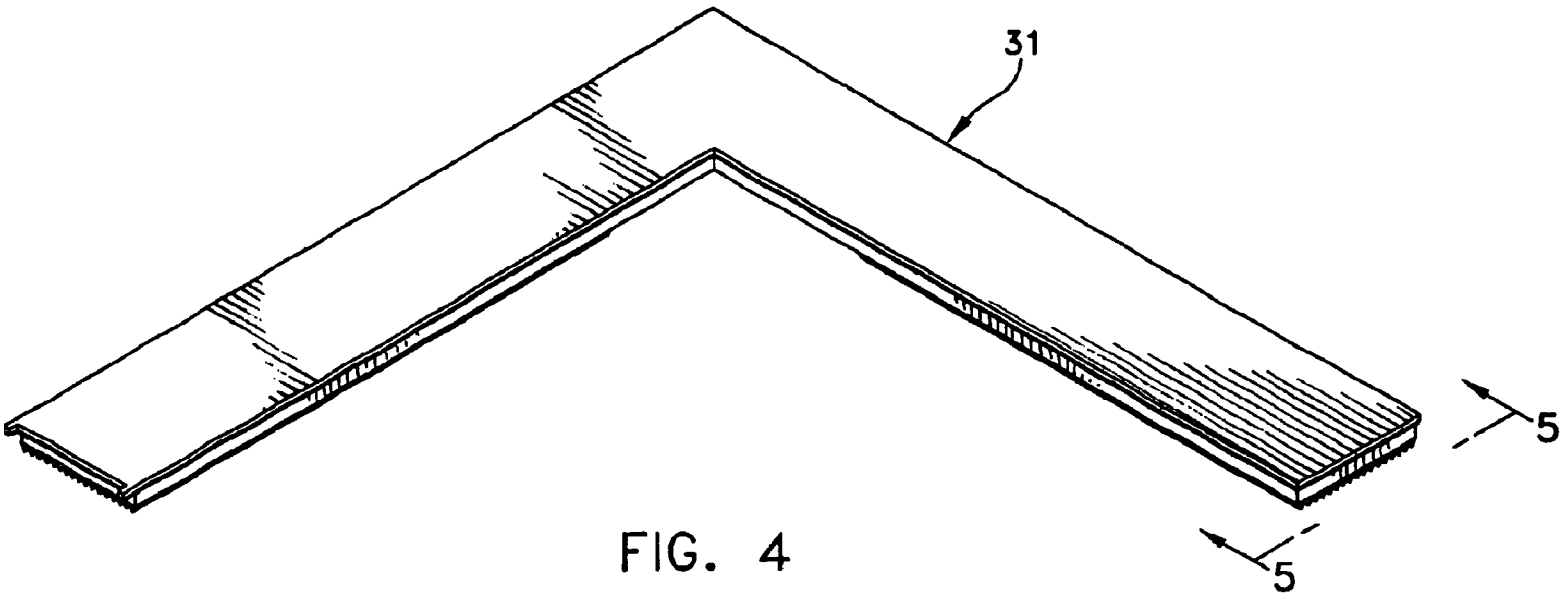
FIG. 4 is a perspective top view of a mandrel used in connection with the method of the present invention.
Figure 11:
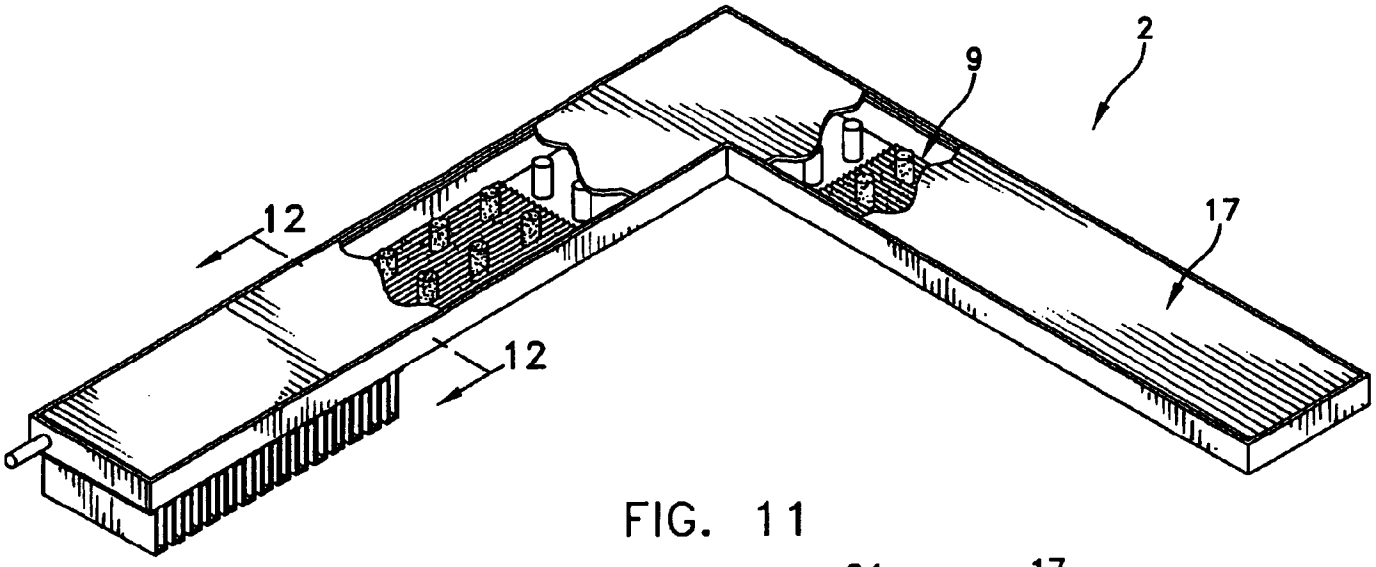
FIG. 11 is a perspective view of a bottom half of a heat pipe heat spreader having a sintered wick formed in portions of its evaporator section and condenser section in accordance with the present invention.
Figure 12:
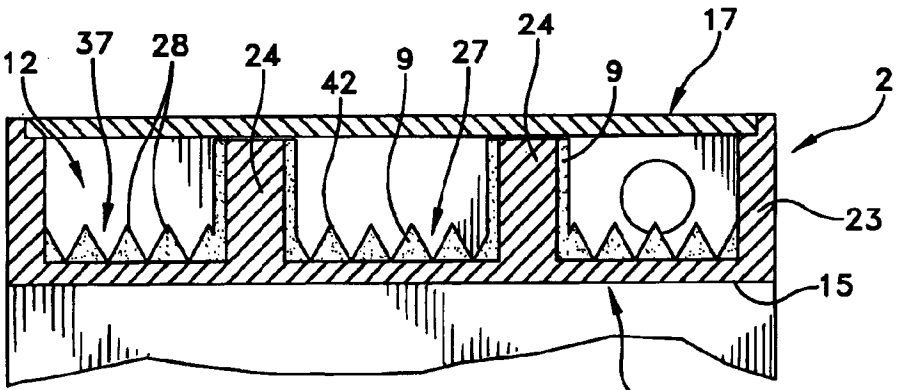
FIG. 12 is a cross-sectional view of the heat pipe heat spreader shown in FIG. 11 as taken along lines 12—12 in FIG. 11.

A vapor chamber 12 is defined between a bottom wall 15 and a top wall 17, and extends transversely and longitudinally throughout planar heat pipe heat spreader 2 (FIGS. 3 and 11). In a preferred embodiment, bottom wall 15 and top wall 17 comprise substantially uniform thickness sheets of a thermally conductive material, and are spaced-apart by about 2.0 (mm) to about 5.0 (mm) so as to form the void space within heat pipe heat spreader 2 that defines vapor chamber 12. Top wall 17 of planar heat pipe heat spreader 2 is substantially planar, and is complementary in shape to bottom wall 15.

Bottom wall 15 preferably comprises a substantially planer outer surface 20, an inner surface 22, a peripheral edge wall 23, and a plurality of outwardly projecting posts 24. Peripheral edge wall 23 projects outwardly from the peripheral edge of inner surface 22 so as to circumscribe inner surface 22. Posts 24 are arranged in a selected pattern that is more dense in evaporator section 5 than in condenser section 7 (FIG. 3). Each post comprises a substantially rectilinear cross-sectional shape, which is very often rectangular prior to coating with a sintered wick (FIG. 3).

Figure 5:
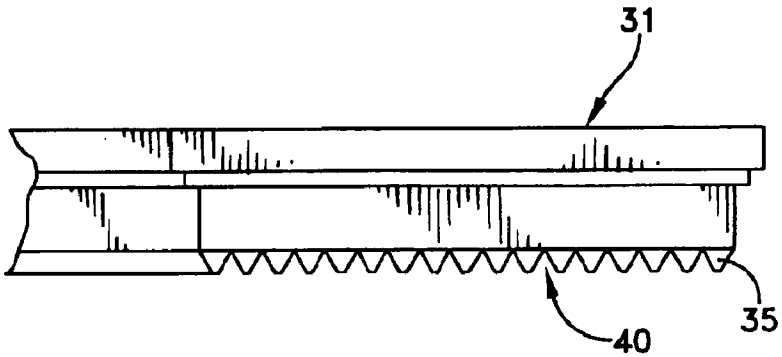
FIG. 5 is broken-way side elevational view of the mandrel shown in FIG. 4.
Figure 7:
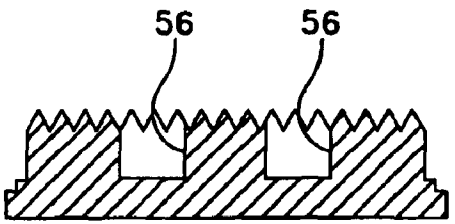
FIG. 7 is a cross-sectional view of a portion of the mandrel shown in FIG. 6.
Figure 6:
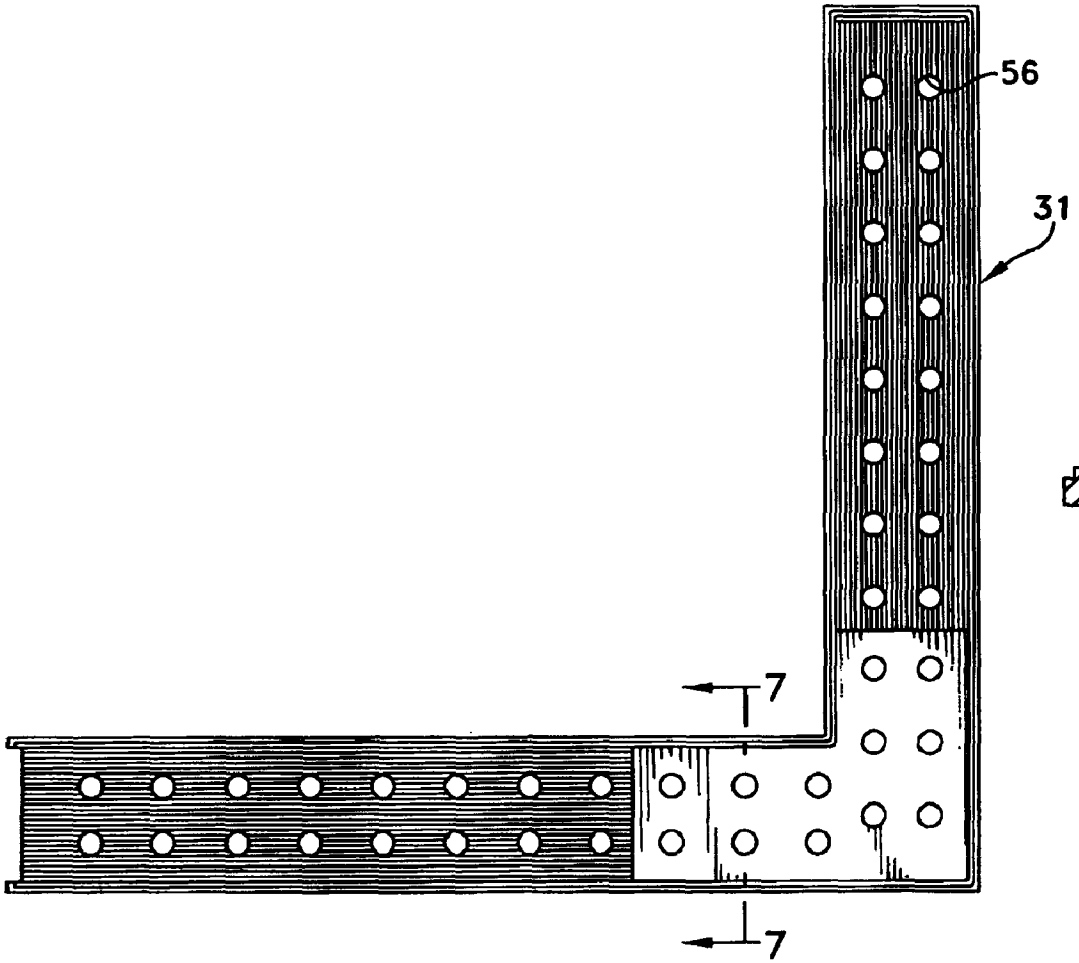
FIG. 6 is a top elevational view of the mandrel shown in FIG. 4.
Figure 8:
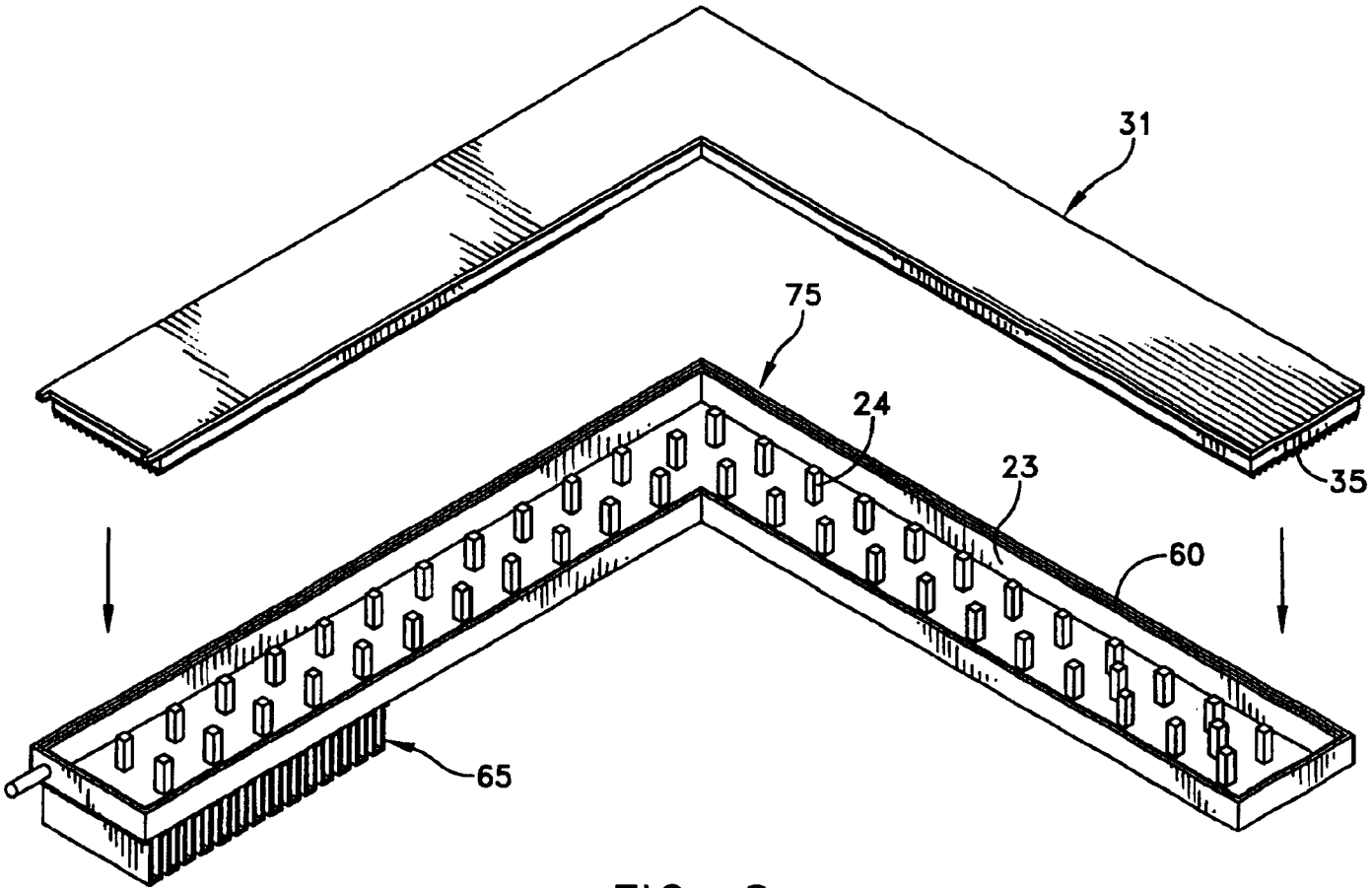
FIG. 8 is an exploded perspective view of a bottom half of a heat pipe heat spreader formed in accordance with the present invention having a mandrel positioned ready for insertion.
Figure 9:
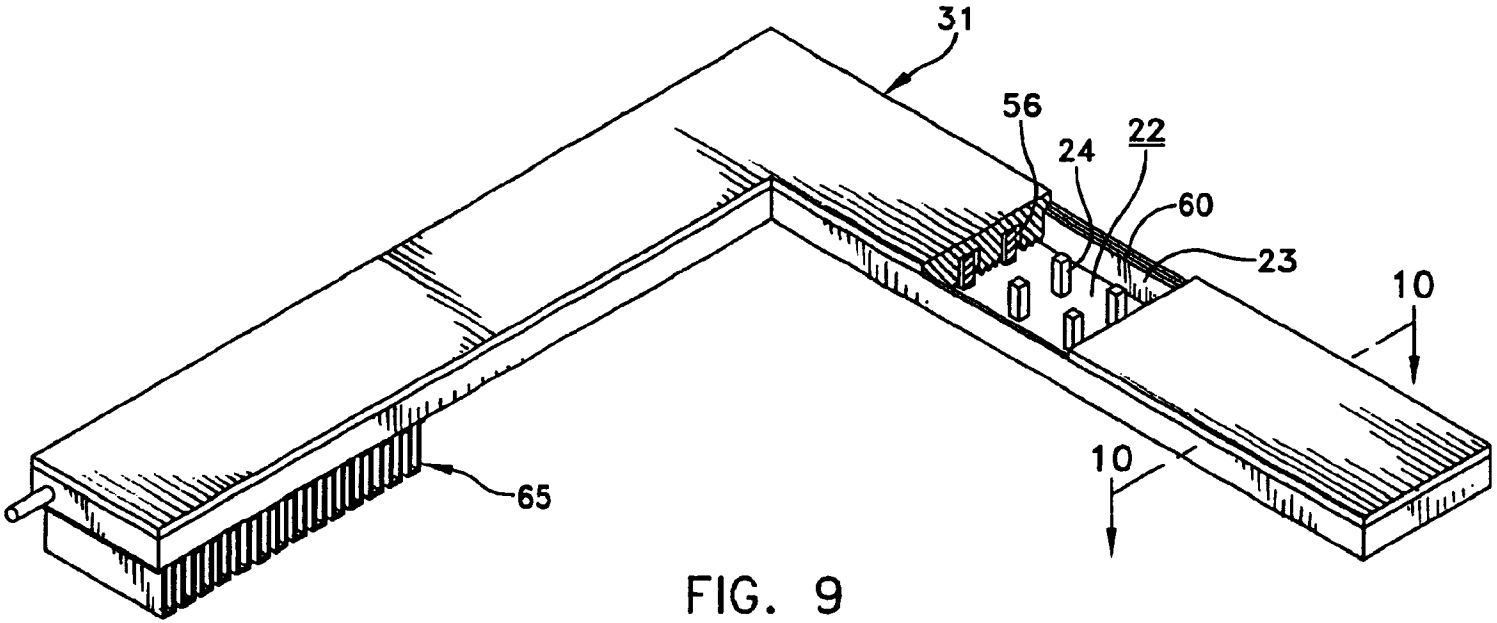
FIG. 9 is a perspective view of the mandrel shown in FIG. 8 positioned within a portion of heat pipe heat spreader, with a portion of the mandrel removed for clarity and illustration.
Figure 10:
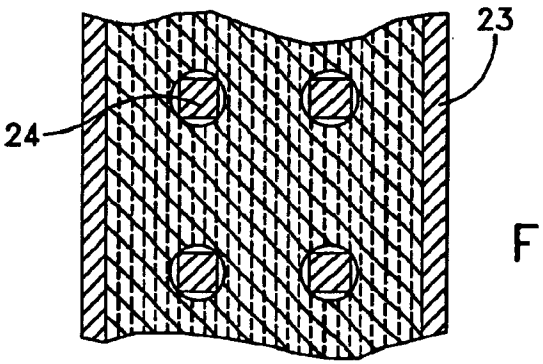
FIG. 10 is a cross-sectional view of the mandrel and portion of heat pipe heat spreader shown in FIG. 10, as taken along lines 10—10 in FIG. 10.
Figure 13:
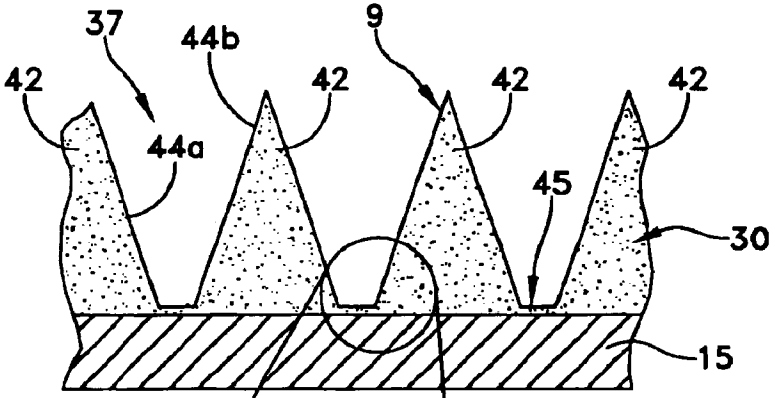
FIG. 13 is a highly enlarged, cross-sectional broken-way view of the lands and grooves that form a portion of the sintered wick, including a groove-wick positioned between adjacent lands.
Figure 14:
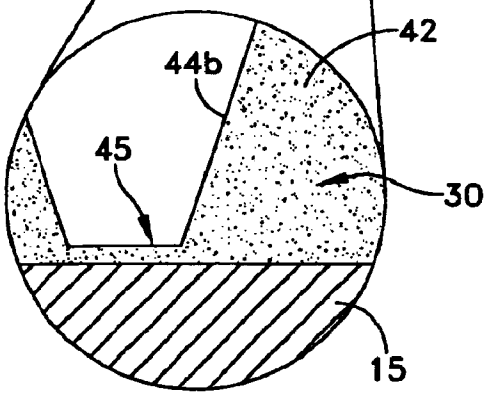
FIG. 14 is a further enlarged elevational view of the groove-wick.

Sintered wick 9 comprises an integral layer of sintered, thermally conductive material, that is formed on at least inner surface 22 of bottom wall 15 and on the side surfaces of posts 24. Sintered wick 9 is formed from metal powder 30 that is sintered in place around a shaped mandrel 31 (FIG. 5) to form a plurality of grooves. Lands 35 of mandrel 31 form grooves 37 of finished wick 9, and grooves 40 of mandrel 31 form lands 42 of wick 9. Each land 42 is formed as an inverted, substantially "V"-shaped or pyramidal protrusion having sloped side walls 44*a*, 44*b*, and is spaced-apart from adjacent lands. Grooves 37 separate lands 42 and are arranged in substantially parallel, longitudinally (or transversely) oriented rows that extend at least through evaporator section 5 and condenser section 7. The terminal portions of grooves 37, adjacent to the 90° bend in peripheral edge wall 23, may be unbounded by further porous structures. Advantageously, a relatively thin layer of sintered powder 30 is deposited upon inner surface 22 of bottom wall 15 so as to form a groove-wick 45 at the bottom of each groove 37 and between lands 42 (FIGS. 13 and 14). Sintered powder 30 may be selected from any of the materials having high thermal conductivity and that are suitable for fabrication into porous structures, e.g., carbon, tungsten, copper, aluminum, magnesium, nickel, gold, silver, aluminum oxide, beryllium oxide, or the like, and may comprise either substantially spherical, arbitrary or regular polygonal, or filament-shaped particles of varying cross-sectional shape. For example, sintered copper powder 30 is deposited between lands 42 such that groove-wick 45 comprises an average thickness of about one to six average copper particle diameters (approximately 0.005 millimeters to 0.5 millimeters, preferably, in the range from about 0.05 millimeters to about 0.25 millimeters) when deposited over substantially all of inner surface 22 of bottom wall 15, and between sloped side walls 44*a*, 44*b* of lands 42. Of course, other wick materials, such as, aluminum-silicon-carbide or copper-silicon-carbide may be used with equal effect.

Significantly groove-wick 45 is formed so as to be thin enough that the conduction delta-T is small enough to prevent boiling from initiating at the interface between inner surface 22 of bottom wall 15 and the sintered powder forming the wick. Groove-wick 45 is an extremely thin wick structure that is fed by spaced lands 42 which provide the required cross-sectional area to maintain effective working fluid flow. In cross-section, groove-wick 45 comprises an optimum design when it comprises the largest possible (limited by capillary limitations) flat area between lands 42 (FIG. 14). This area should have a thickness of, e.g., only one to six copper powder particles. The thinner groove-wick 45 is, the better performance within realistic fabrication constraints, as long as the surface area of inner surface 22 has at least one layer of copper particles. This thin wick area takes advantage of the enhanced evaporative surface area of the groove-wick layer, by limiting the thickness of groove-wick 45 to no more than a few powder particles. This structure has been found to circumvent the thermal conduction limitations associated with the prior art. Sintered wick 9 also forms a coating on each of posts 24, which stand proud of grooves 37 thereby providing both a heat transfer and support structure within heat pipe heat spreader 2.

Referring to FIGS. 4–10, sintered grooved wick 9 is formed on inner surface 22 of bottom wall 15 by the following process. Mandrel 31 that comprises an over all shape and size that are complementary to bottom wall 15 so that mandrel 31 may be removably seated within peripheral edge wall 23 on inner surface 22. Mandrel 31 comprises a plate having a plurality of substantially "V"-shaped grooves 40 located between adjacent, triangularly shaped lands 35, and a plurality of blind bores 56 (FIGS. 6 and 7) arranged so as to complement the pattern of posts 24 arranged on bottom wall 15 of evaporator section 5 and condenser section 7. "V"-shaped grooves 40 are arranged in substantially parallel, longitudinally oriented rows. Plurality of blind bores 56 are defined in the plate, and arranged in a selected pattern through portions of grooves 40 and lands 35. Advantageously, blind openings 56 are arranged in a more dense pattern in that portion of mandrel 31 that corresponds to evaporator section 5. Each blind bore 56 comprises a substantially cylindrical cross-sectional shape, which is very often circular.

Sintered wick 9 is formed on inner surface 22 of heat pipe heat spreader 2 by first positioning mandrel 31 within the bottom half of heat pipe heat spreader 2 (identified generally in FIG. 2 by reference numeral 75) so that the tips of lands 35 are within about one to six average metal powder particle diameters (i.e., approximately 0.005 millimeters to 0.5 millimeters, preferably, in the range from about 0.05 millimeters to about 0.25 millimeters) from inner surface 22. A slurry of metal powder particles having the foregoing average particle diameter are suspended in a viscous binder, and introduced into the voids between mandrel 31 and inner surface 22 so as to coat at least part of the inside surface of the container with the slurry. In this way, the slurry conforms to the grooved contour of mandrel 31 and forms a layer of slurry between adjacent grooves that comprises no more than about six average particle diameters. The slurry is then dried to form a green wick, and then heat treated to yield a final composition of wick 9.

Vapor chamber 12 is created by the attachment of bottom wall 15 and top wall 17, along their common edges which are then hermetically sealed at their joining interface 60. A two-phase vaporizable liquid (e.g., ammonia or freon not shown) resides within vapor chamber 12, and serves as the working fluid for heat pipe heat spreader 2. Heat pipe heat spreader 2 is formed by drawing a partial vacuum within vapor chamber 12 and injecting the working fluid just prior to final hermetic sealing of the common edges of bottom wall 15 and top wall 17. For example, heat pipe heat spreader 2 (including bottom wall 15 and top wall 17) may be made of copper or copper silicon carbide with water, ammonia, or freon generally chosen as the two-phase vaporizable liquid.

Referring to FIG. 2, a folded fin heat exchanger 65 is mounted to outer surface 20 of bottom wall 15 by soldering, brazing, or epoxy. Folded fin heat exchanger 65 is formed by folding a continuous sheet of thermally conductive material, such as copper, aluminum, or their alloys, back-and-forth upon itself so as to create a pleated or corrugated cross-sectional profile. More particularly, fin heat exchanger 65 includes peripheral side edges 72 and a plurality of substantially parallel, fin walls 74 separated from one another by alternating flat ridges 76 and troughs 78. Each pair of thin fin walls 74 are spaced apart by a flat ridge 76 so as to form each trough 78 between them. Thus folded fin heat exchanger 65 comprises a continuous sheet of thermally conductive material folded into alternating flat ridges 76 and troughs 78 defining spaced fin walls 74 having peripheral end edges 72. Each flat ridge 76 provides a flat top surface that is less prone to damage, and is more suitable for brazing, soldering, or welding, or otherwise thermally attaching flat ridge 76 to outer surface 20 of top wall 17.

It is to be understood that the present invention is by no means limited only to the particular constructions herein disclosed and shown in the drawings, but also comprises any modifications or equivalents within the scope of the claims.

What is claimed is:

1. A heat pipe heat spreader comprising:

an enclosure having an internal surface and a plurality of post projecting from said internal surface wherein said posts are (i) arranged in a selected pattern that is more dense in one portion of said internal surface, and (ii) coated with a sintered wick powder;

a working fluid disposed within said enclosure; and a grooved wick disposed on at least a portion of said internal surface and including a plurality of individual particles having an average diameter, said grooved wick including at least two spaced-apart lands that are in fluid communication with one another through a particle layer disposed between said at east two spaced-apart lands that comprises less than about six average particle diameters.

2. A heat pipe according to claim 1 wherein said said particle layer comprises a thickness that is less than about three average particle diameters.

3. A heat pipe according to claim 1 wherein said particles are formed substantially of copper.

4. A heat pipe according to 1 wherein six average particle diameters is within a range from about 0.005 millimeters to about 0.5 millimeters.

* * * * *